US008348341B2

(12) United States Patent
Hsiao

(10) Patent No.: US 8,348,341 B2
(45) Date of Patent: Jan. 8, 2013

(54) CHAIR ASSEMBLY WITH A BACKREST-ADJUSTING DEVICE

(76) Inventor: Yun-Chien Hsiao, Tainan (TW)

( * ) Notice: Subject to any disclaimer, the term of this patent is extended or adjusted under 35 U.S.C. 154(b) by 268 days.

(21) Appl. No.: 12/886,780

(22) Filed: Sep. 21, 2010

(65) Prior Publication Data

US 2012/0068509 A1 Mar. 22, 2012

(51) Int. Cl.
*A47C 1/032* (2006.01)

(52) U.S. Cl. ..... 297/300.4; 297/301.3; 297/303.3

(58) Field of Classification Search ..... 297/292, 297/296, 298, 300.4, 301.3, 303.3
See application file for complete search history.

(56) References Cited

U.S. PATENT DOCUMENTS 3,072,436 A * 1/1963 Moore ..... 297/316
3,601,444 A * 8/1971 Doerner ..... 297/301.3
4,065,176 A * 12/1977 Fontana ..... 297/301.3
5,725,277 A * 3/1998 Knoblock ..... 297/300.4
5,964,503 A * 10/1999 Inoue ..... 297/300.4
6,168,233 B1 * 1/2001 Markus ..... 297/302.3
6,659,554 B2 * 12/2003 Su ..... 297/301.3
6,779,847 B2 * 8/2004 Klein ..... 297/301.2
6,840,578 B1 * 1/2005 Su ..... 297/302.3

* cited by examiner

*Primary Examiner* — Peter R. Brown
(74) *Attorney, Agent, or Firm* — Rosenberg, Klein & Lee

(57) ABSTRACT

A chair assembly has a base frame, a pivot frame, a backrest frame, a seat frame and a backrest-adjusting device. The pivot frame is mounted pivotally on the base frame. The backrest frame is mounted securely on the pivot frame. The backrest-adjusting device is mounted between the base frame and the pivot frame and has a torsion spring biasing the pivot frame and the backrest frame to pivot forward. The backrest-adjusting device tightens or loosens the torsion spring to change the resilient force provided to the backrest frame against users' back. Therefore, the chair assembly adapts to differ users well.

6 Claims, 8 Drawing Sheets

CHAIR ASSEMBLY WITH A BACKREST-ADJUSTING DEVICE

BACKGROUND OF THE INVENTION

1. Field of the Invention

The present invention relates to a chair assembly, and more particularly to a chair assembly that has a backrest-adjusting device providing the backrest with resilient force against a user's back. The backrest-adjusting device is capable of adjusting the resilient force for different users.

2. Description of Related Art

Chairs are an important piece of furniture commonly used in people's daily lives to provide people with comfort and facilitation when they sit thereon.

A conventional chair has a supporting base, a seat, a backrest and two handrails. The seat is mounted on the supporting base. The backrest is mounted on the supporting base behind the seat. The handrails are mounted oppositely on the seat. But the conventional chair cannot adjust the angle of the backrest relative to the seat for different users.

Another kind of conventional chair has been developed to allow users to change the angle of the backrest. Furthermore, a spring is mounted between the backrest and the seat to provide backrest with resilient force against a user's back. When using the chair, the user's back abuts the backrest against the resilient force and changes the angle of the backrest so that after a balance between the resilient force and the user's pressing force is achieved, the user adjusts to an optimal sitting position and the backrest stops at a specific angle.

However, the resilient force corresponding to each angle of the backrest is constant and cannot be adjusted. Different users need to apply the same pressing force against the resilient force to hold the backrest at a same angle. A relative able-bodied and heavy user may feel that the resilient force from the backrest is insufficient and the backrest is too soft to hold his/her body. On the other hand, a relative small and light user may feel that the resilient force from the backrest is excessive and the backrest is to too hard. In other words, the chair cannot adapt to different users.

To overcome the shortcomings, the present invention provides a chair assembly with a backrest-adjusting device to mitigate or obviate the aforementioned problems.

SUMMARY OF THE INVENTION

The main objective of the invention is to provide a chair assembly that has a backrest-adjusting device providing the backrest with resilient force against a user' back. The backrest-adjusting device is capable of adjusting the resilient force for different users.

A chair assembly in accordance with the present invention comprises a base frame, a pivot frame, a backrest frame, a seat frame and a backrest-adjusting device. The pivot frame is mounted pivotally on the base frame. The backrest frame is mounted securely on the pivot frame. The backrest-adjusting device is mounted between the base frame and the pivot frame and has a torsion spring biasing the pivot frame and the backrest frame to pivot forward. The backrest-adjusting device selectively tightens or loosens the torsion spring to change the resilient force provided to the backrest frame against a user' back. Therefore, the chair assembly can adapt to differ users.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
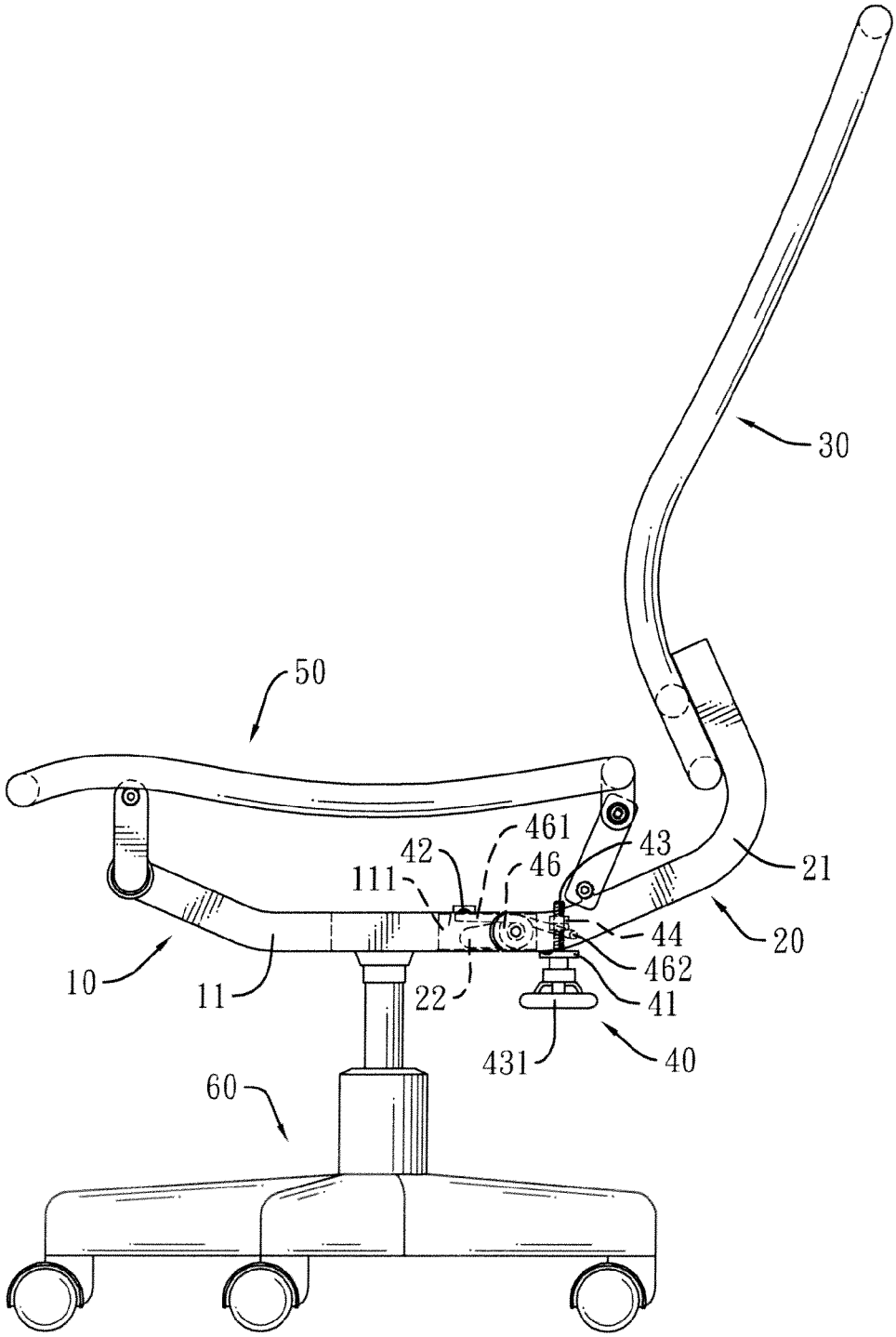
FIG. 1 is a side view of a chair assembly with a backrest-adjusting device in accordance with the present invention.
Figure 2:
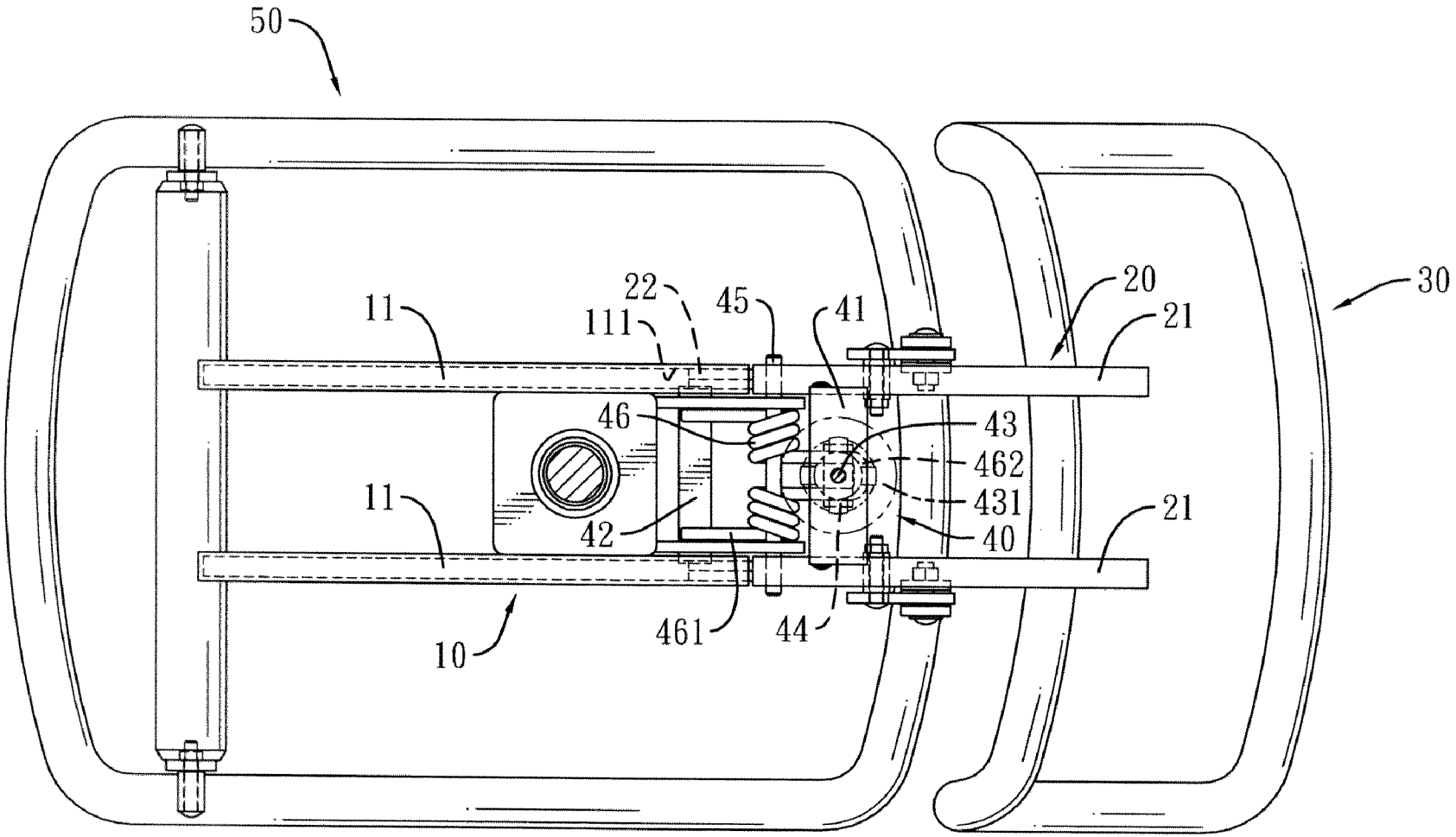
FIG. 2 is a bottom view of the chair assembly in FIG. 1.
Figure 3:
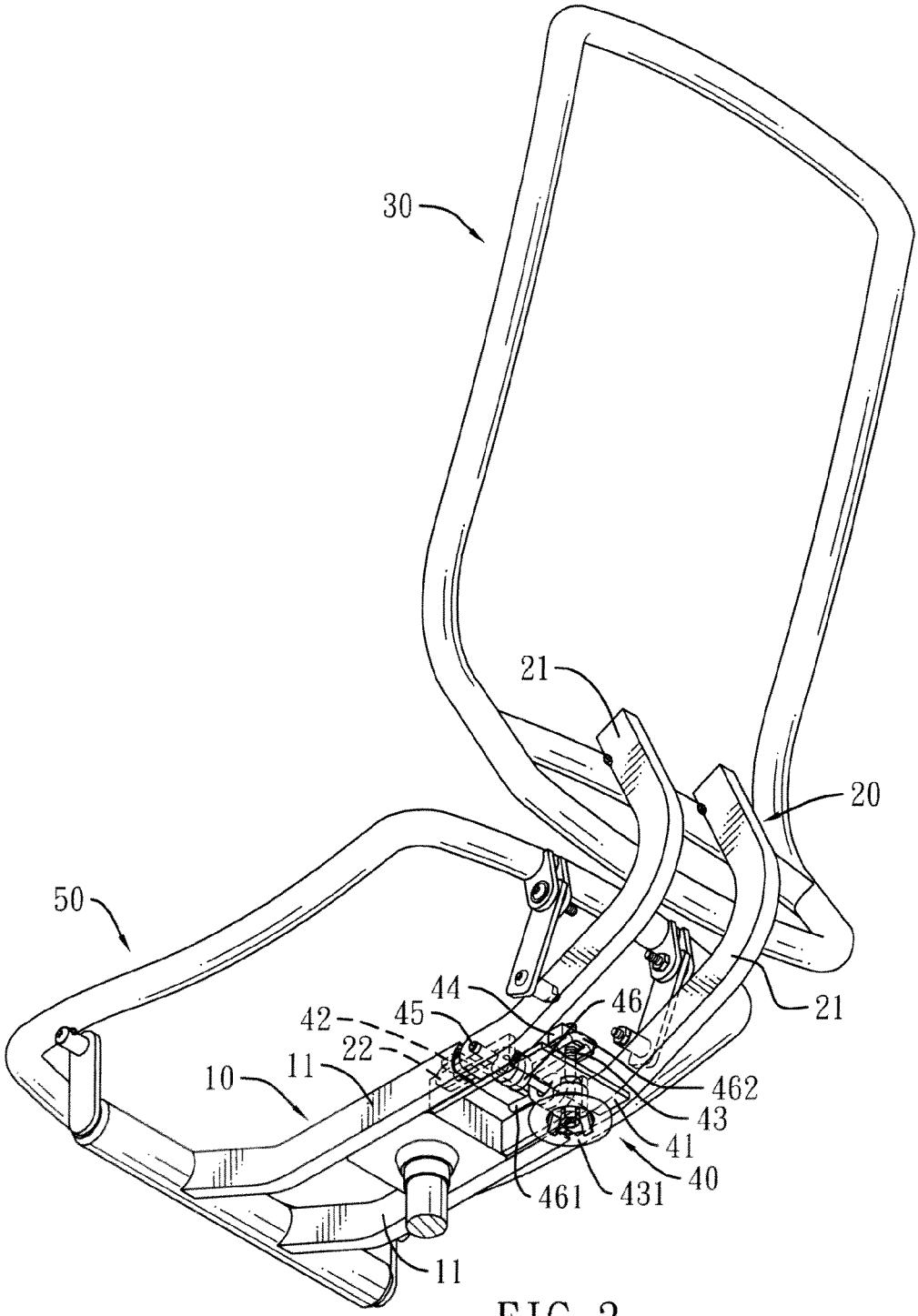
FIG. 3 is a perspective view of the chair assembly in FIG. 1.

With reference to FIGS. 1 to 3, a chair assembly in accordance with the present invention comprises a base frame (10), a pivot frame (20), a backrest frame (30), a seat frame (50) and a backrest-adjusting device (40) and may further have a stand (60).

Figure 4:
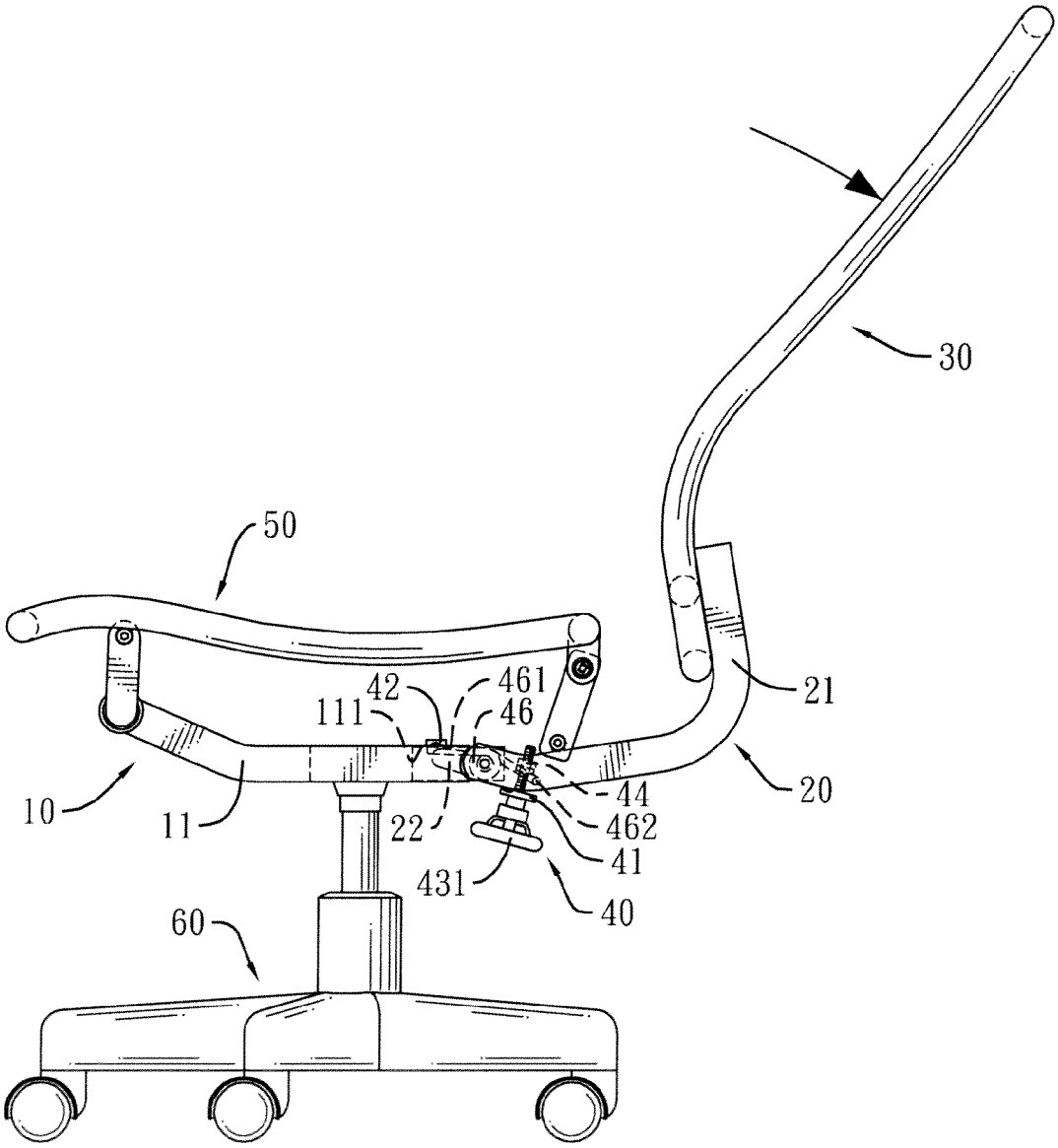
FIG. 4 is an operational side view of the chair assembly in FIG. 1 showing that the backrest frame is pressed back.
Figure 8:
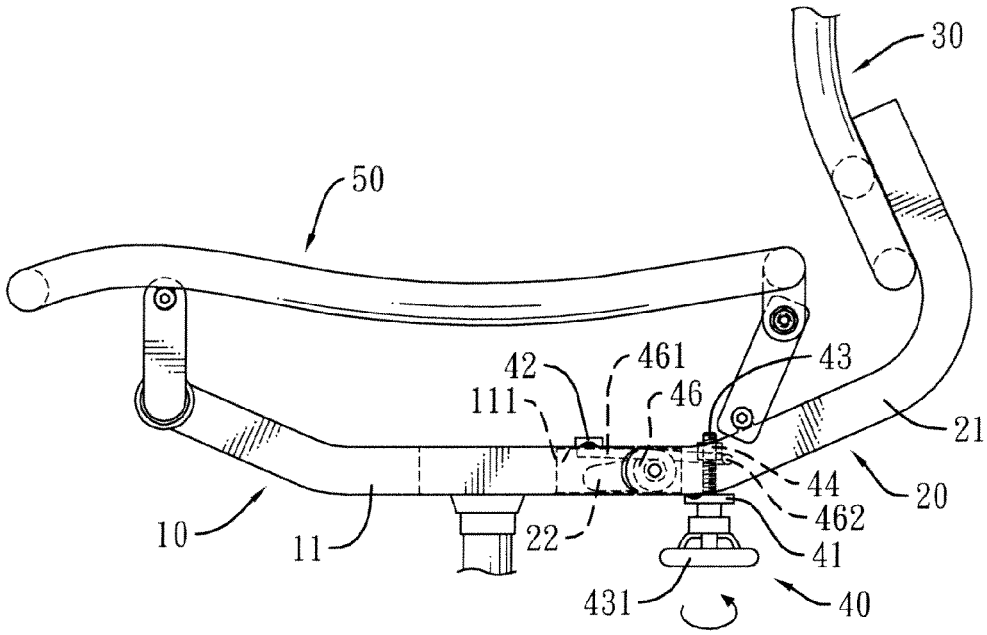
FIG. 8 is an enlarged side view of the chair assembly in FIG. 5.
Figure 9:
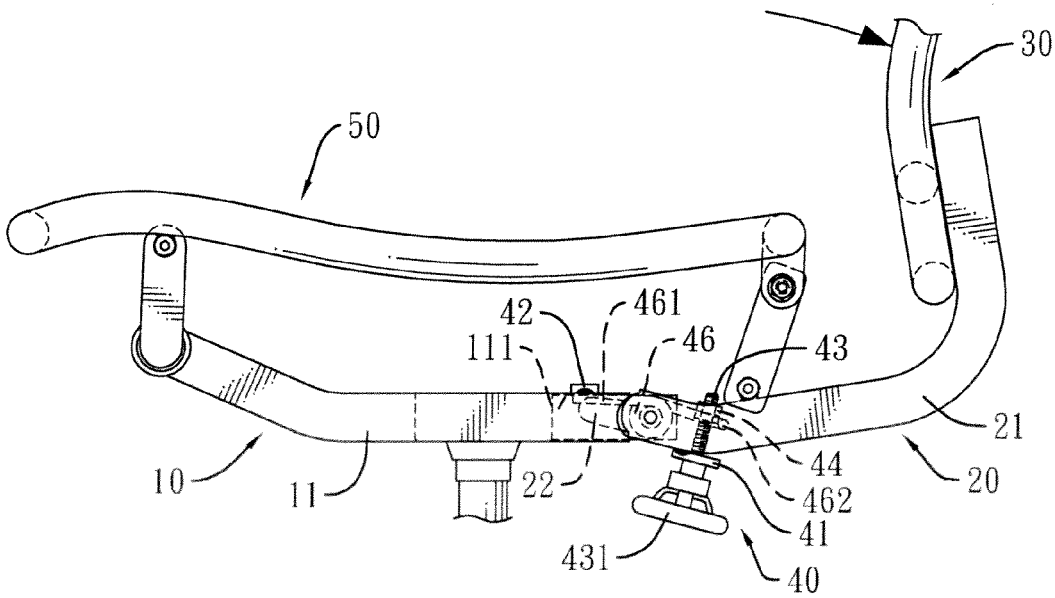
FIG. 9 is an enlarged side view of the chair assembly in FIG. 7.

With further reference to FIGS. 4, 8 and 9, the base frame (10) has two mounting bars (11). The mounting bars (11) may be longitudinal and each mounting bar (11) has a front end and a rear end and may further have a limiting slot (111). The limiting slot (111) is defined in the rear end of the mounting bar (11) and has a top inner surface and a bottom inner surface.

The pivot frame (20) is mounted pivotally on the rear ends of the mounting bars (11) of the base frame (10) and has two pivoting bars (21). The pivoting bars (21) may be longitudinal and are mounted pivotally and respectively on the rear ends of the mounting bars (11). Each pivoting bar (21) may have a limiting protrusion (22) formed on the front end of the pivoting bar (21), mounted movably in the limiting slot (111) of one of the mounting bars (11) and selectively abutting the top or bottom inner surface of the limiting slot (111). The limiting slot (111) and the limiting protrusion (22) prevent the pivot frame (20) from over pivoting relative to the base frame (10).

The backrest frame (30) may be looped and substantially rectangular and is mounted securely on the pivoting bars (21) of the pivot frame (20).

The seat frame (50) may be looped and substantially rectangular and is mounted on the base frame (10) and the pivot frame (20). The seat frame (50) is pivotally mounted on the base frame (10) and the pivot frame (20).

The backrest-adjusting device (40) is mounted between the base frame (10) and the pivot frame (20) and has a mounting bracket (41), a stopper (42), an adjusting bolt (43), an adjusting nut (44), a mounting pin (45) and a torsion spring (46).

The mounting bracket (41) is mounted securely on the pivoting bars (21) of the pivot frame (20).

The stopper (42) is mounted securely on the mounting bars (11) of the base frame (10).

The adjusting bolt (43) has a connecting end and an adjusting end and may further have a wheel handle (431). The connecting end is mounted rotatably on the mounting bracket (41). The adjusting end is defined opposite to the connecting end. The wheel handle (431) is mounted securely on the connecting end.

The adjusting nut (44) is screwed movably around the adjusting bolt (43).

The mounting pin (45) is mounted securely on the pivoting bars (21).

The torsion spring (46) is mounted on the pivoting bars (21) of the pivot frame (20), biasing the pivot frame (20) and the backrest frame (30) to pivot forward. The torsion spring (46) may be mounted around the mounting pin (45) on the pivoting bars (21) and has at least one abutment end (461) and a regulating end (462). The at least one abutment end (461) tightly abuts the stopper (42). The regulating end (462) is defined opposite to the abutment end (461) and presses against the adjusting nut (44). Accordingly, rotating the adjusting bolt (43) moves the adjusting nut (44) along the adjusting bolt (43) and changes a torque of the torsion spring (46). When the torque is increased, the torsion spring (46) provides the backrest frame (30) with more resilient force. Decreasing the torque provides the backrest frame (30) with less resilient force.

The stand (60) is mounted under the base frame (10) and may have multiple wheels facilitating the movement of the chair assembly.

Figure 5:
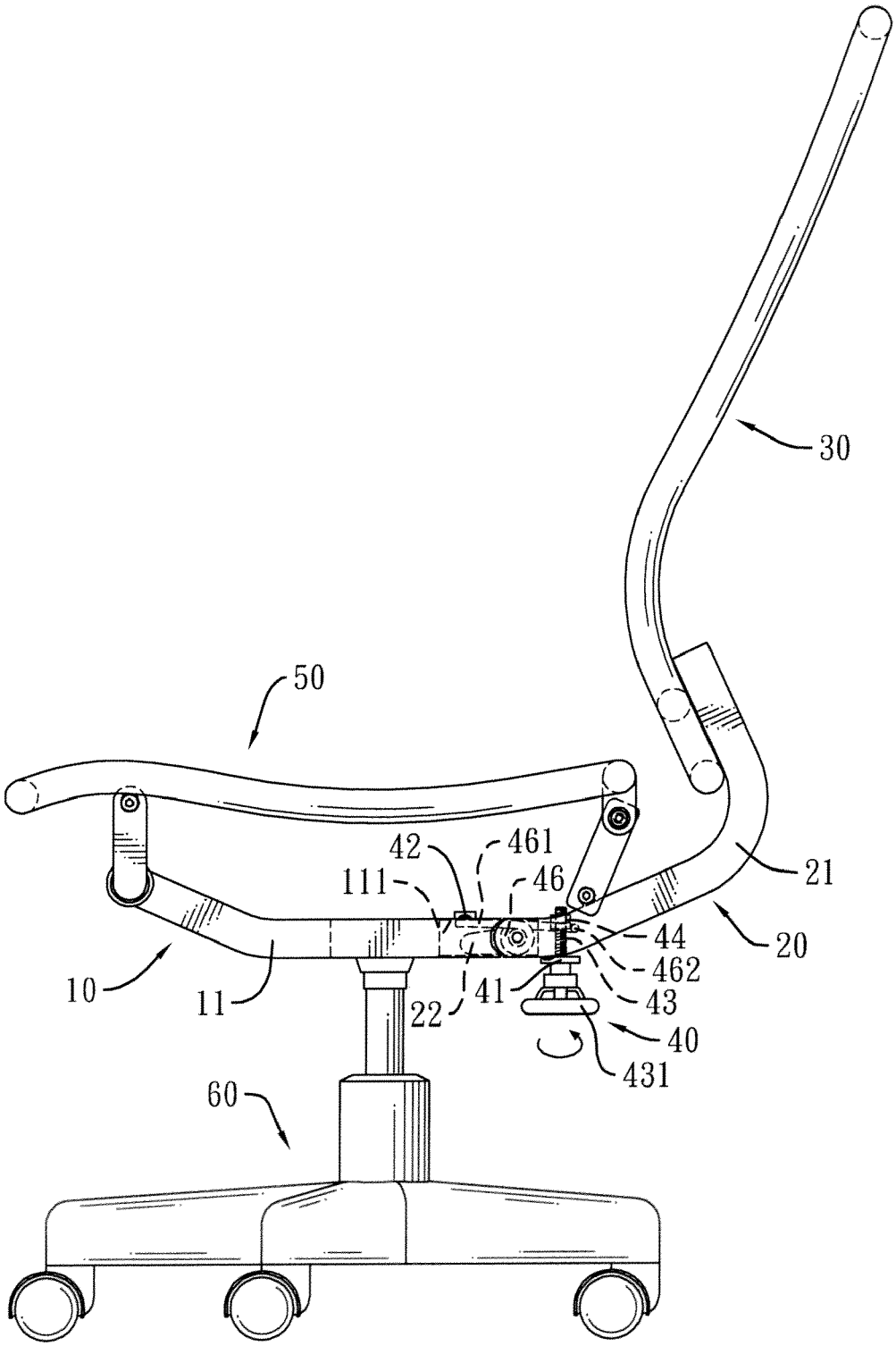
FIG. 5 is an operational side view of the chair assembly in FIG. 1 showing that the adjusting bolt is adjusted to increase the resilient force.
Figure 6:
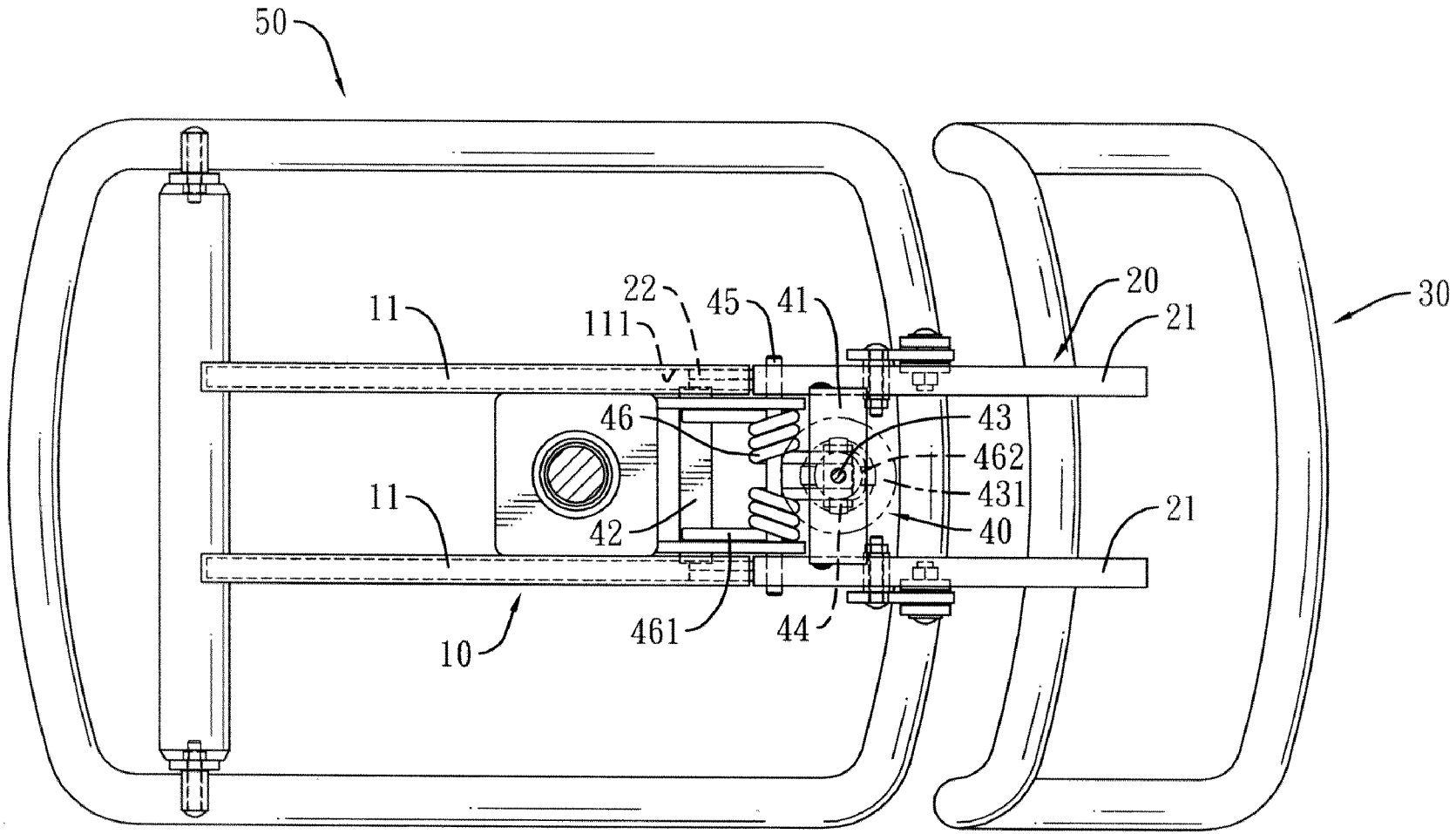
FIG. 6 is a bottom view of the chair assembly in FIG. 5.
Figure 7:
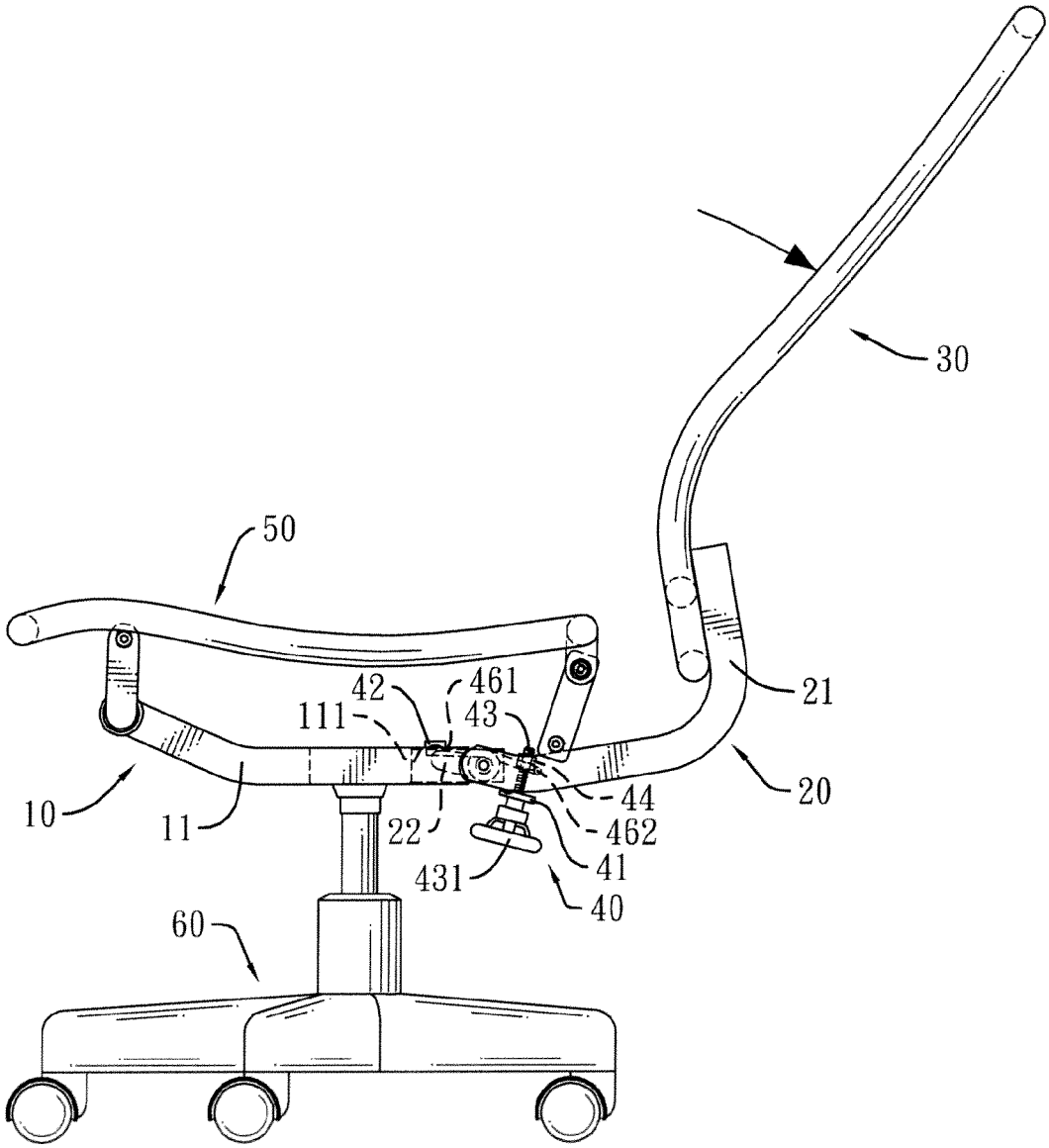
FIG. 7 is an operational side view of the chair assembly in FIG. 5 showing that the backrest frame is pressed back.

With further reference to FIGS. 5 to 7, the adjusting bolt (43) is rotated to move the adjusting nut (44) away from the mounting bracket (41). The adjusting end (462) of the torsion spring (46) is released somewhat so that the torsion spring (46) is loosened. The resilient force given to the backrest frame (30) against a user' back is decreased so that the user feels backrest frame (30) comparatively softer. On the contrary, moving the adjusting nut (44) toward the mounting bracket (41) tightens the torsion spring (46) and increases the resilient force against the user's back. The user feels the backrest frame (30) comparatively harder.

The backrest-adjusting device (40) allows users to change the resilient force from the backrest frame (20) so that the chair assembly can adapt to different users with different statures.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A chair assembly comprising:

a base frame having two mounting bars and each mounting bar having a front end and a rear end;

a pivot frame mounted pivotally on the rear ends of the mounting bars of the base frame and having two pivoting bars mounted pivotally and respectively on the rear ends of the mounting bars;

a backrest frame mounted securely on the pivoting bars of the pivot frame;

a seat frame mounted on the base frame and the pivot frame; and a backrest-adjusting device mounted between the base frame and the pivot frame and having a mounting bracket mounted securely on the pivoting bars of the pivot frame;

a stopper mounted securely on the mounting bars of the base frame;

an adjusting bolt having a connecting end mounted rotatably on the mounting bracket; and an adjusting end defined opposite to the connecting end;

an adjusting nut screwed movably around the adjusting bolt; and a torsion spring mounted on the pivoting bars of the pivot frame, biasing the pivot frame and the backrest frame to pivot forward and having at least one abutment end tightly abutting the stopper; and a regulating end defined opposite to the abutment end and presses against the adjusting nut;

wherein rotating the adjusting bolt moves the adjusting nut along the adjusting bolt and changes a torque of the torsion spring.

2. The chair assembly as claimed in claim 1, wherein the backrest-adjusting device further has a mounting pin mounted securely on the pivoting bars of the pivot frame and the torsion spring is mounted around the mounting pin.

3. The chair assembly as claimed in claim 2, wherein each mounting bar further has a limiting slot defined in the rear end of the mounting bar and having a top inner surface and a bottom inner surface; and each pivoting bar further has a limiting protrusion formed on the front end of the pivoting bar, mounted movably in the limiting slot of one of the mounting bars and selectively abutting the top or bottom inner surface of the limiting slot.

4. The chair assembly as claimed in claim 3, wherein the seat frame is pivotally mounted on the base frame and the pivot frame.

5. The chair assembly as claimed in claim 4, wherein the adjusting bolt further has a wheel handle mounted securely on the connecting end.

6. The chair assembly as claimed in claim 5 further comprising a stand mounted on the base frame.

* * * * *